US009458636B2

(12) United States Patent
Moller, Jr. et al.

(10) Patent No.: US 9,458,636 B2
(45) Date of Patent: Oct. 4, 2016

(54) MULTI-STAGE SHOCK ABSORBING MODULAR FLOOR TILE APPARATUS

(71) Applicant: SnapSports Company, Salt Lake City, UT (US)

(72) Inventors: Jorgen J. Moller, Jr., Salt Lake City, UT (US); Jeremiah D. Shapiro, Herriman, UT (US)

(73) Assignee: SNAPSPORTS COMPANY, Salt Lake City, UT (US)

( * ) Notice: Subject to any disclaimer, the term of this patent is extended or adjusted under 35 U.S.C. 154(b) by 0 days.

(21) Appl. No.: 14/854,338

(22) Filed: Sep. 15, 2015

(65) Prior Publication Data

US 2016/0010343 A1 Jan. 14, 2016

Related U.S. Application Data

(62) Division of application No. 14/031,993, filed on Sep. 19, 2013, now Pat. No. 9,133,628.

(51) Int. Cl.

| | |
|---|---|
| ***E04F 15/22*** | (2006.01) |
| ***E04F 15/02*** | (2006.01) |
| ***E04F 15/10*** | (2006.01) |

(52) U.S. Cl.

CPC ..... *E04F 15/225* (2013.01); *E04F 15/02* (2013.01); *E04F 15/02038* (2013.01); *E04F 15/10* (2013.01); *E04F 2201/0146* (2013.01); *E04F 2201/021* (2013.01)

(58) Field of Classification Search

CPC . E04F 15/225; E04F 15/02; E04F 15/02038; E04F 15/10; E04F 2201/021; E04F 2201/0146; F16F 1/44; F16F 1/373

See application file for complete search history.

(56) References Cited

U.S. PATENT DOCUMENTS

| | | | | |
|---|---|---|---|---|
| 1,806,341 | A * | 5/1931 | Gavaza | A47B 91/12 248/615 |
| 1,969,266 | A | 8/1934 | Herold | |
| 2,194,653 | A | 3/1940 | Gell | |
| 2,357,120 | A * | 8/1944 | Kuebert | F16F 1/3615 248/632 |
| 2,458,621 | A | 1/1949 | Miller | |
| 2,631,330 | A * | 3/1953 | Becker | A47B 91/04 16/30 |
| 3,368,806 | A | 2/1968 | Szonn | |
| 3,909,996 | A * | 10/1975 | Ettlinger, Jr. | E01C 5/20 15/215 |
| 4,296,160 | A | 10/1981 | Forlenza | |
| 4,860,516 | A * | 8/1989 | Koller | A63C 19/00 52/480 |
| 4,879,857 | A * | 11/1989 | Peterson | E01C 13/02 248/632 |
| 4,890,434 | A | 1/1990 | Niese | |
| 5,118,086 | A | 6/1992 | Stevenson et al. | |
| 5,277,010 | A * | 1/1994 | Stephenson | E04F 15/225 52/403.1 |

(Continued)

FOREIGN PATENT DOCUMENTS

| | | | | |
|---|---|---|---|---|
| DE | 3545969 A1 | | 9/1986 | |
| GB | 2356205 A | * | 5/2001 | E04F 15/20 |
| JP | 02236355 A1 | | 9/1999 | |

*Primary Examiner* — Adriana Figueroa
(74) *Attorney, Agent, or Firm* — Holland & Hart

(57) ABSTRACT

Modular floor tiles and modular floor systems are described herein. A floor tile system includes a modular floor tile and a plurality of resilient support assemblies. The modular floor tile includes a top surface layer having a top surface and a bottom surface and a plurality of rigid support portions extending from the bottom surface. The resilient support assemblies are supported against the bottom surface and include an outer resilient support portion having a hollow interior, and an inner resilient support portion positioned centrally relative to the outer resilient support portion.

6 Claims, 12 Drawing Sheets

(56) References Cited

U.S. PATENT DOCUMENTS 5,303,526 A * 4/1994 Niese ..... E04F 15/04 52/393
5,364,204 A * 11/1994 MacLeod ..... A63C 19/12 404/35
5,509,244 A * 4/1996 Bentzon ..... E01C 5/005 428/44
5,682,724 A 11/1997 Randjelovic
6,357,717 B1 3/2002 Kennard, IV
6,363,675 B1 4/2002 Shelton
6,742,312 B2 * 6/2004 Valentine ..... E04F 15/225 248/632
7,267,318 B2 * 9/2007 Kennard, IV ..... F16F 1/373 248/562
7,303,800 B2 12/2007 Rogers
7,735,280 B2 * 6/2010 Valentine ..... E04F 15/225 248/632
7,743,882 B2 * 6/2010 Vu ..... F16F 15/08 181/207
8,099,915 B2 1/2012 Moller, Jr. et al.
8,353,640 B2 * 1/2013 Sawyer ..... E01C 11/225 404/2
2002/0063369 A1 5/2002 Huang
2005/0230891 A1 * 10/2005 Griffin ..... B60G 7/04 267/292
2006/0001205 A1 * 1/2006 Raza ..... F16F 1/371 267/152
2009/0031658 A1 * 2/2009 Moller, Jr. ..... E01C 5/20 52/403.1

* cited by examiner

MULTI-STAGE SHOCK ABSORBING MODULAR FLOOR TILE APPARATUS

RELATED APPLICATION

This is a division of U.S. patent application Ser. No. 14/031,993 filed on 19 Sep. 2013, now U.S. Pat. No. 9,133,628, issued 15 Sep. 2015, the disclosure of which is incorporated, in its entirety, by this reference.

TECHNICAL FIELD

This relates generally to floor tiles, and more particularly to modular floor tiles with removable shock absorbing members.

BACKGROUND

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles can be interconnected to one another to cover large floor areas such as a garage, an office, or a show floor. Other interconnected tile systems are used as dance floors and sports court surfaces.

However, typical interconnected tile systems are rigid and unforgiving. Short and long term use of modular floors for sports activities and dance can result in discomfort to the users. Conventional interconnected tile systems absorb little, if any, of the impact associated with walking, running, jumping, and dancing. Consequently, some users may experience pain or discomfort of the joints when using the interconnected tile systems. Therefore, there is a need for modular interconnected tile systems that include features that provide a more comfortable, useful surface.

SUMMARY

Some embodiments address the above-described needs and others. In one of many possible embodiments, a floor tile system is provided. The floor tile system includes a modular floor tile and a plurality of resilient support assemblies. The modular floor tile includes a top surface layer having a top surface and a bottom surface and a plurality of rigid support portions extending from the bottom surface. The resilient support assemblies are supported against the bottom surface and include an outer resilient support portion having a hollow interior, and an inner resilient support portion positioned centrally relative to the outer resilient support portion.

The outer and inner resilient support portions may have different flexibility properties. The outer and inner resilient support portions may have different material compositions. The outer and inner resilient support portions may be formed integrally as a single piece. The inner resilient support portion may extend further from the bottom surface of the top surface layer than the outer resilient support portion.

The outer resilient support portion has a length and a variable outer diameter along the length. The inner resilient support portion may have a solid construction. The outer and inner resilient support portions may be separately mounted to the modular floor tile. At least one of the rigid support portions may be positioned in the hollow interior. The inner resilient support portion may apply a radially outward directed force to the outer resilient support portion. The plurality of resilient support assemblies may extend further from the bottom surface than the plurality of rigid support portions.

Another aspect of the present disclosure relates to a modular floor tile comprising a top surface layer and at least one resilient support assembly. The top surface layer include top and bottom surfaces. The at least one resilient support assembly includes a first resilient support portion supported against the bottom surface, and a second resilient support portion having a different compressibility property than the first resilient support portion. The first and second resilient support portions may be separately compressible toward the top surface layer.

The modular floor tile may also include a plurality of rigid support members extending from the bottom surface. The first and second resilient support portions may be mounted to at least some of the plurality of rigid support members. The first and second resilient support portions may be releasably coupled to the top surface layer. The first resilient support portion may have a hollow interior and the second resilient support portion may be positioned in the hollow interior. The first and second resilient support portions may be separately coupled to the top surface layer.

A further aspect of the present disclosure relates to a modular floor tile support assembly that includes first and second resilient support portions. The second resilient support portion extends from an end of the first resilient support portion. The first and second resilient support portions provide multi-stage shock absorption for a modular floor tile.

The first resilient support portion may include a cavity. The first resilient support portion may have a lower compressibility than a compressibility of the second resilient support portion. The first and second resilient support portions may be separately mountable to the modular floor tile.

Another aspect of the present disclosure relates to a method of assembling a modular floor tile. The method includes providing a modular floor tile having a top surface layer and a plurality of rigid support members extending from the top surface layer, and providing at least one resilient support assembly comprising first and second resilient support portions. The method also includes mounting the first resilient support portion to the modular floor tile, and mounting the second resilient support portion to the modular floor tile.

Providing the at least one resilient support assembly may include forming the first and second resilient support portions as a single, unitary piece. Providing the at least one resilient support assembly may include forming the first and second resilient support portions as separate pieces. Mounting the first and second resilient support portions may include concurrently mounting the first and second resilient support portions to the modular floor tile. Mounting the first resilient support portion may include creating an interference fit between the plurality of rigid support members and the first resilient support portion. Mounting the second resilient support portion may include positioning at least one of the plurality of rigid support members between the first and second resilient support portions.

Another example method relates to a method of shock absorption in a modular floor tile assembly. The method includes providing a modular floor tile having a bottom surface and a top surface, and at least one resilient support member having a first portion and a second portion. The first portion has a different compressibility property as compared to the second portion. The method includes mounting the resilient support member to the modular floor tile with the second portion extending further from the bottom surface than the first portion, and applying a force to the top surface to compress the second portion followed by compressing the first portion.

Compressing the first portion may require a greater amount of force than compressing the second portion. The first and second portions may have different shapes and sizes.

The foregoing features and advantages, together with other features and advantages, will become more apparent when referring to the following specification, claims and accompanying drawings.

BRIEF DESCRIPTION OF THE DRAWINGS

The accompanying drawings illustrate various embodiments and are a part of the specification. The illustrated embodiments are merely examples and do not limit the claims.

Throughout the drawings, identical reference numbers designate similar, but not necessarily identical, elements.

DETAILED DESCRIPTION

Figure 1:
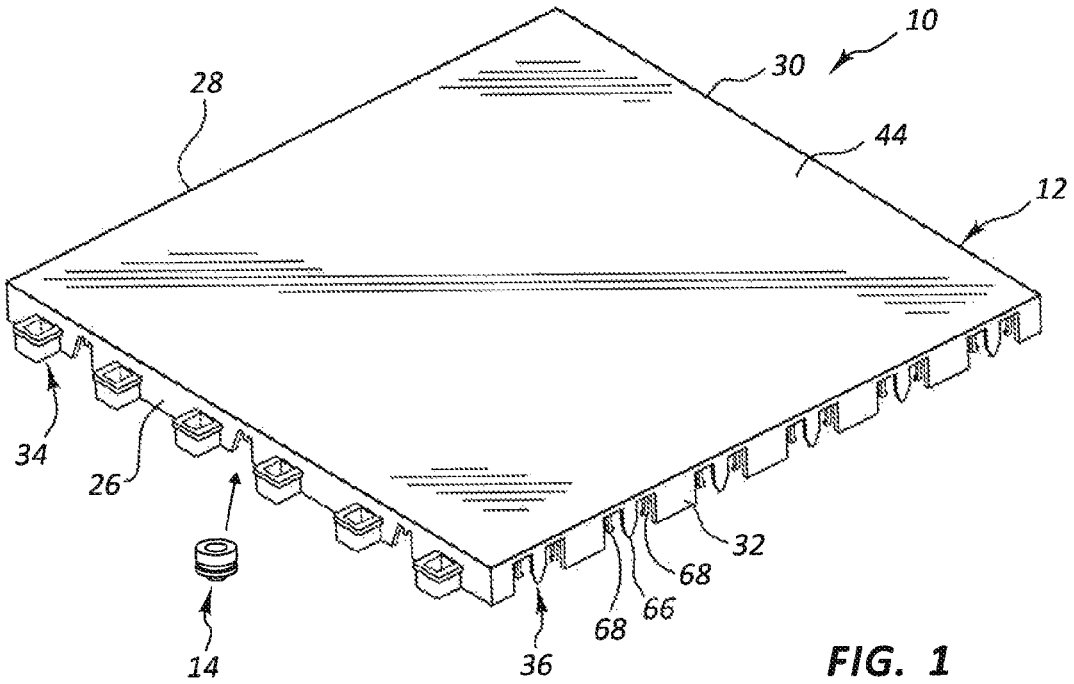
FIG. 1 is a perspective view of an example floor tile system in accordance with the present disclosure.

As mentioned above, typical modular flooring are rigid and unforgiving and provide little, if any, shock absorption. The principles described herein present methods and apparatuses that provide improved shock absorption and more flexibility than previous flooring systems. The application of the principles described herein is not limited to the specific embodiments shown. The principles described herein may be used with any flooring system. Moreover, although certain embodiments shown incorporate multiple novel features, the features may be independent and need not all be used together in a single embodiment. Tiles and flooring systems according to principles described herein may comprise any number of the features presented. Therefore, while the description below is directed primarily to interlocking plastic modular floors, the methods and apparatus are only limited by the appended claims.

As used throughout the claims and specification, the term "modular" refers to objects of regular or standardized units or dimensions, as to provide multiple components for assembly of flexible arrangements and uses. "Resilient" means capable of returning to an original shape or position, as after having been compressed; rebounds readily. "Rigid" means stiff or substantially lacking flexibility. However, a "rigid" support system may flex or compress somewhat under a load, although to a lesser degree than a "resilient" support system. A "post" is a support or structure that tends to be vertical. A "top" surface of a modular tile refers to the exposed surface when the tile is placed on a support, or the designated surface for stepping on, driving on, supporting objects, etc. An "insert" is an object at least partially inserted or intended for insertion relative to another object. A "post" may be cylindrical, but is not necessarily so. "Shock absorbing" means capable of smoothing out or dampening shock forces, and dissipating kinetic energy. The words "including" and "having," as used in the specification, including the claims, have the same meaning as the word "comprising."

One aspect of the present disclosure relates to a floor tile system that includes a modular floor tile and a plurality of resilient insert members connected to the modular floor tile. The modular floor tile may have an open top construction, which is common for outdoor use, or a closed or solid top construction, which is more common for indoor use. The resilient insert members are typically mounted to a bottom side of the modular floor tile. The resilient insert members may be mounted to the modular floor tile in various ways either individually or collectively as an interconnected group of resilient insert members. Some example resilient insert members and ways of mounting the same to the modular floor tile are disclosed in U.S. Pat. No. 8,099,915, which is incorporated herein in its entirety by this reference.

The resilient insert members may include features that provide a multi-stage shock absorbing function. For example, the resilient insert members may include a first portion compressible upon application of a force to the modular floor tile. After the first portion is compressed or deformed a certain amount, a second portion of the resilient insert members begins to absorb the force applied to the modular floor tile. The force required to compresses the first portion may be referred to as a first force, and the force required to compress the second portion may be referred to as a second force. The second force may be greater than the first force and may have a magnitude above a threshold force.

The resilient insert member may be integrally formed as a single piece having multiple portions that react differently to different applied forces to the tile. In other arrangements, the resilient insert member includes a plurality of separate pieces assembled together prior to being mounted to the tile or assembled as part of being mounted to the tile. Each individual piece of a resilient insert member may provide different shock absorbing functions, wherein the various shock absorbing functions may provide multiple stages of shock absorption as forces (e.g., loads) are applied to the modular floor tile.

Figure 2:
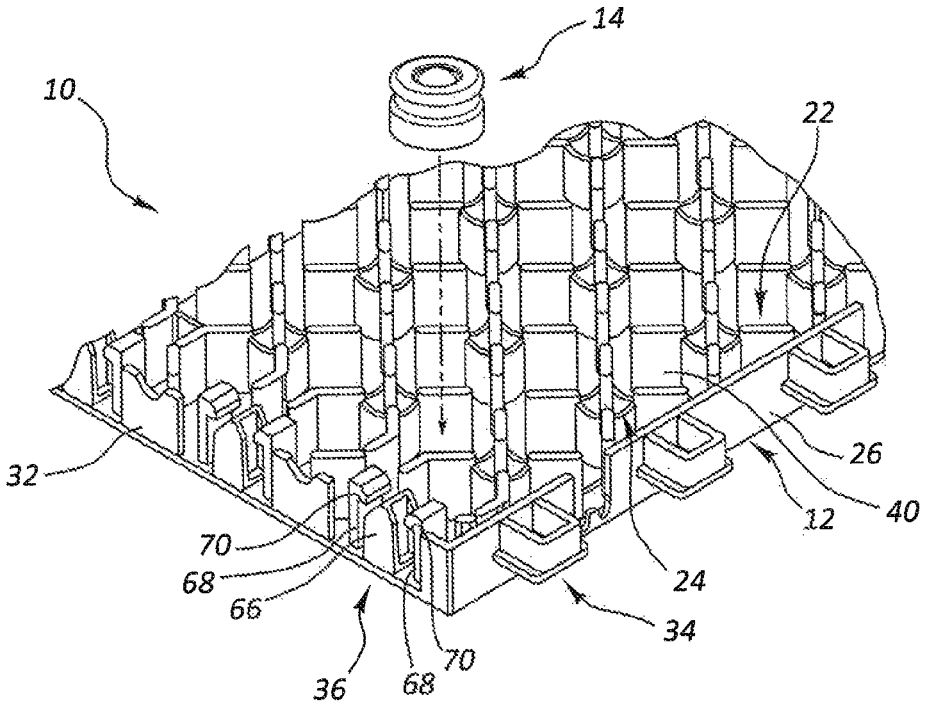
FIG. 2 is a bottom perspective view of a portion of the floor tile system of FIG. 1.
Figure 3:
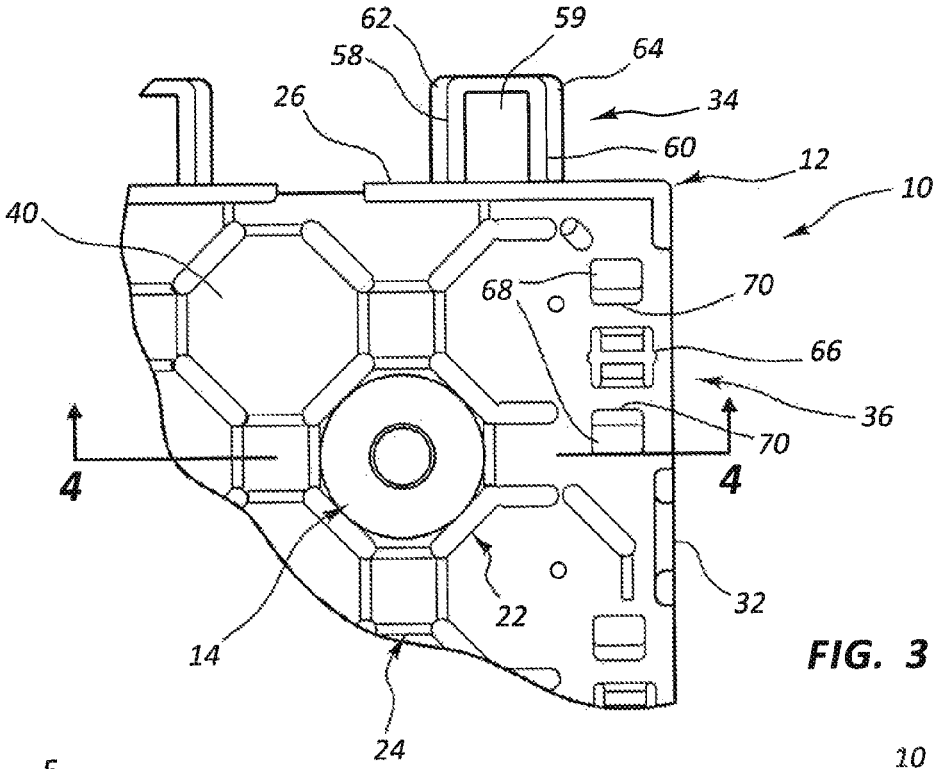
FIG. 3 is a bottom view of a portion of the floor tile system of FIG. 1.

Referring to FIGS. 1-6, a floor tile system 10 having a modular floor tile 12 and a single piece resilient insert member 14 is shown and described. FIGS. 1 and 2 show resilient insert member 14 removed from modular floor tile 12. FIGS. 3-6 show resilient insert member 14 mounted to modular floor tile 12.

Figure 31:
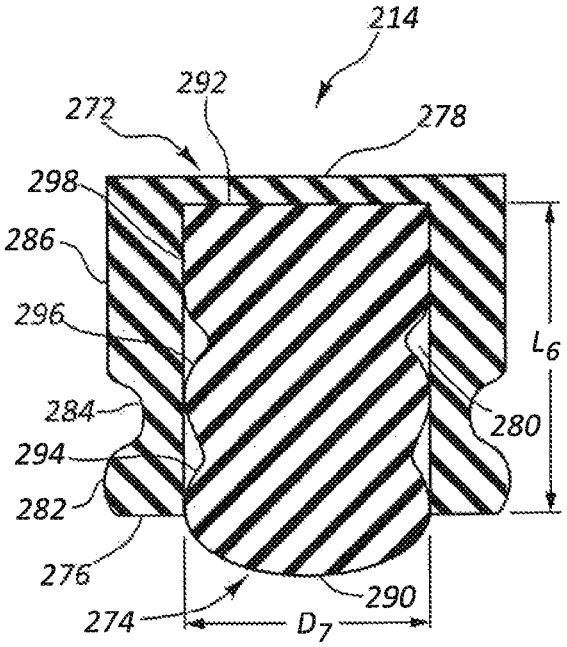
FIG. 31 is a cross-sectional view of the resilient insert assembly of FIG. 30 taken along cross-section indicators 31-31.
Figure 32:
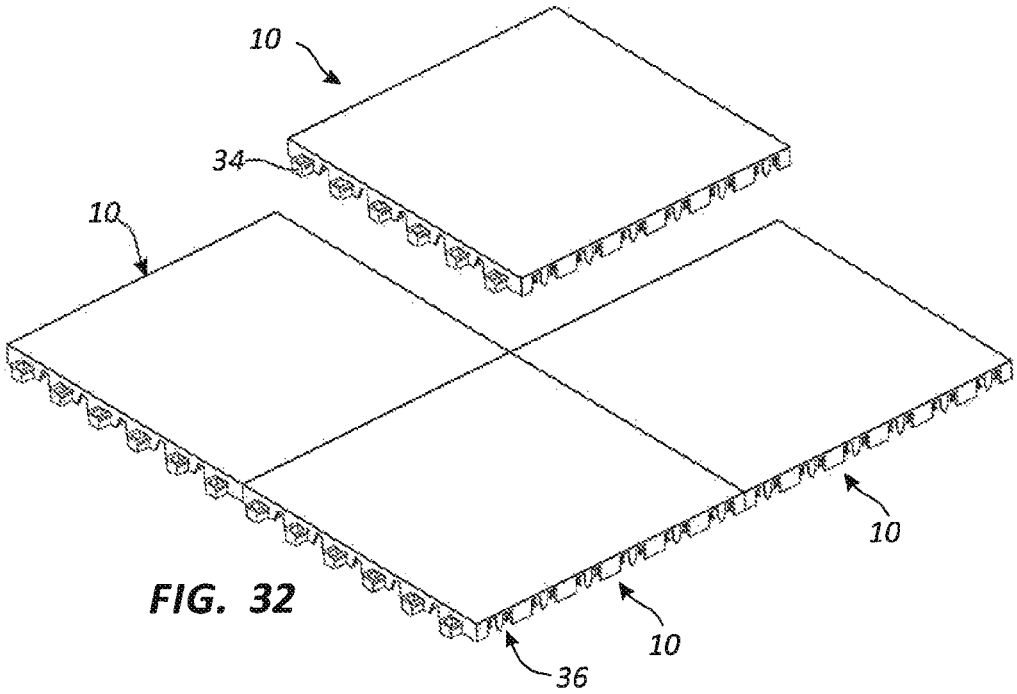
FIG. 32 is a perspective view of multiple floor tile systems connected together according to the present disclosure.

Modular floor tile 12 includes a closed top surface with a top surface layer 20, a plurality of first rigid support members 22 (see FIG. 2), a plurality of second rigid support members 24 (see FIG. 2), side edges 26, 28, 30, 32 (see FIG. 1), a plurality of loops 34 (see FIG. 1), and a plurality of locking tab assemblies 36 (see FIG. 2). Top surface layer 20 includes top and bottom surfaces 44, 46 (see FIG. 4). First rigid support members 22 each include first and second ends (see FIG. 4). Second rigid support members 24 are interposed between the first rigid support members 22 (see FIG. 2). Loops 34 are configured to receive and releasably connect to locking tab assemblies 36 of adjacent modular floor tiles 12. An example arrangement of a plurality of interlocking modular floor tiles is shown in FIG. 32. An application of a plurality of interlocking modular floor tiles in the form of a basketball court is shown in FIG. 31.

Each of the loops 34 include first and second sides 58, 60, an aperture 59, and first and second lips 62, 64. Each of the locking tab assemblies 36 includes a center post 66, a pair of flanking hooks 68, and prongs 70 carried on the flanking hooks 68 (see FIG. 2). Center post 66 is arranged and configured to extend through aperture 59 of loop 34. Flanking hooks 68 extend along first and second sides 58, 60 of loops 34. Prongs 70 engage with first and second lips 62, 64 to provide a positive connection between locking tab assemblies 36 and loops 34. The connection between locking tab assemblies 36 and loops 34 is typically a releasable connection.

Modular floor tile 12 may also include a plurality of seats or nests 40 sized to receive the resilient insert members 14. FIG. 2 shows a plurality of seats 40 arranged along a bottom side of the modular floor tile 12. The seats 40 may be defined at least in part by the first and second rigid support members 22, 24 and the bottom surface 46 of top surface layer 20. Each of the seats 40 may be configured to releasably mount a single resilient insert member 14 to modular floor tile 12. In at least one example, any number of resilient insert members 14 may be mounted to modular floor tile 12 up to the number of seats 40 positioned across the bottom surface of modular floor tile 12. The number and positioning of resilient insert members 14 may be varied to customize the cushioning and/or shock absorbing effect for the floor tile system 10.

Figure 4:
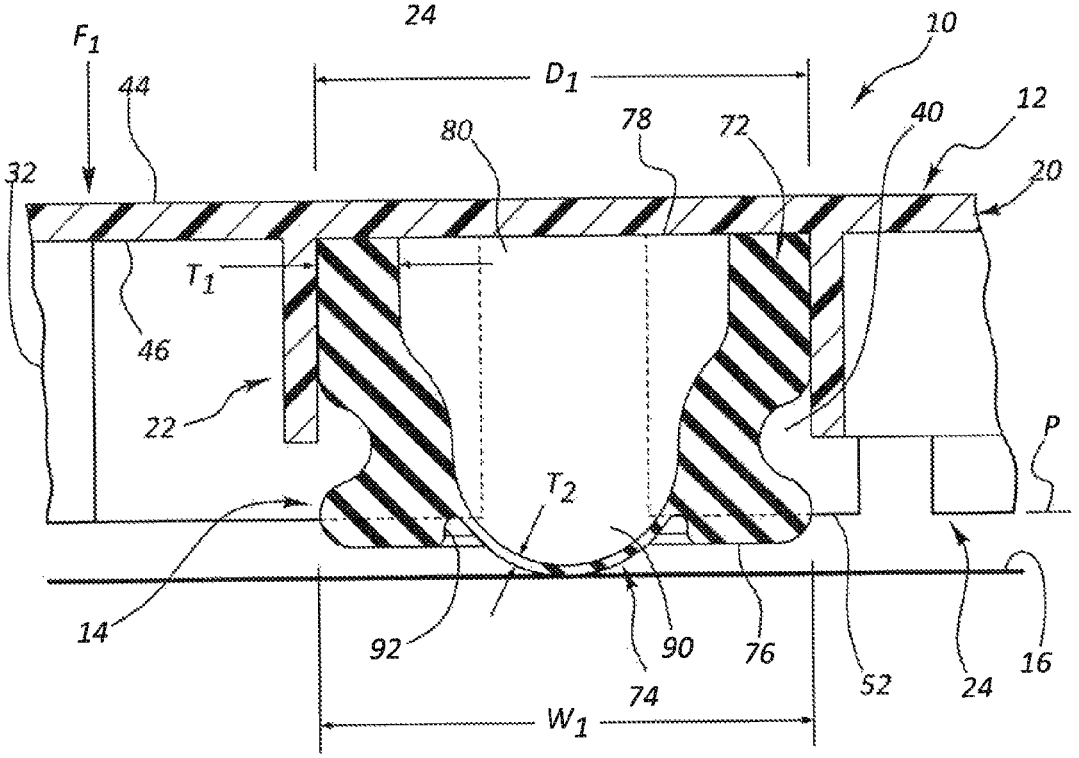
FIG. 4 is a cross-sectional view of the portion of the floor tile system of FIG. 3 taken along cross-section indicators 4-4.

Resilient insert members 14 may be sized to fit within seat 40 with an interference fit connection. For example, a width $W_1$ of seat 40 may be equal to or slightly less than a maximum diameter $D_1$ of resilient insert member 14, as shown in FIG. 4. In other arrangements, seat 40 may include connecting features such as protrusions that extend from first rigid support members 22 and into contact with resilient insert members 14 to provide a positive connection with the resilient insert member 14. In some arrangements, the resilient insert members 14 are permanently connected within seat 40.

Resilient insert member 14 may directly contact or abut against bottom surface 46 of top surface layer 20 within seat 40. Resilient insert member 14 may be disposed entirely under top surface layer 20 or at least under top surface 44 of top surface layer 20.

Figure 7:
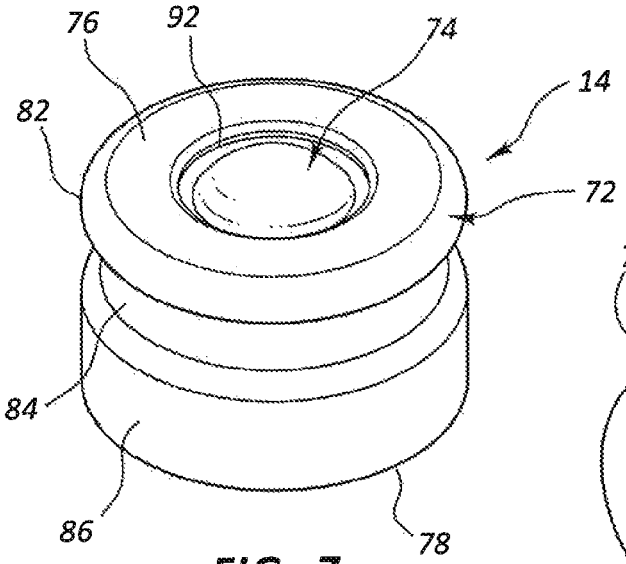
FIG. 7 is a bottom perspective view of the resilient insert shown in FIGS. 1-6.
Figure 8:
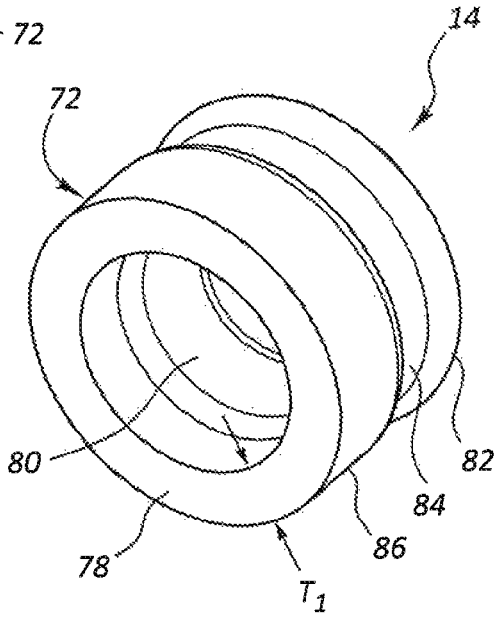
FIG. 8 is a top perspective view of the resilient inset shown in FIG. 7.
Figure 9:
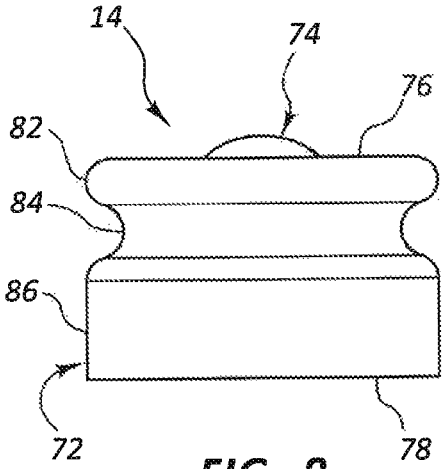
FIG. 9 is a side view of the resilient insert shown in FIG. 7.
Figure 10:
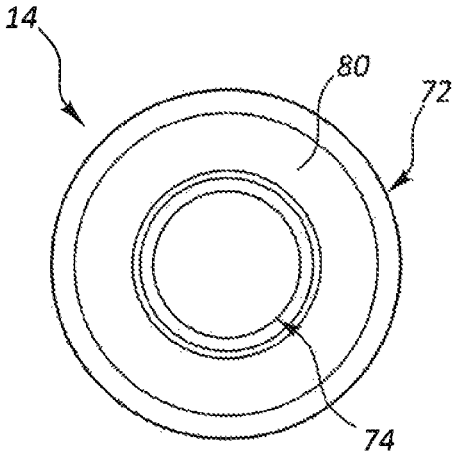
FIG. 10 is a bottom view of the resilient insert shown in FIG. 7.
Figure 11:
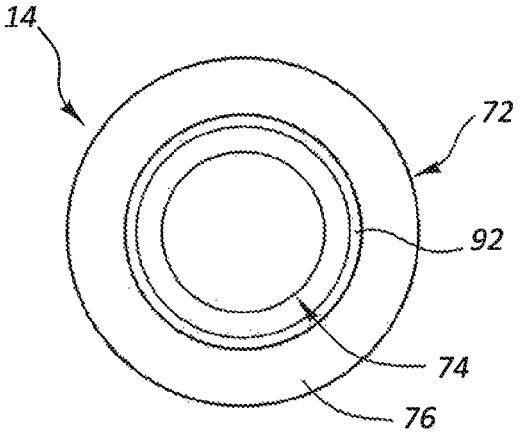
FIG. 11 is a top view of the resilient insert shown in FIG. 7.

Resilient insert member 14 is shown in further detail in FIGS. 7-11. Resilient insert member 14 includes a base portion 72 and a dimple portion 74. Base portion 72 may be referred to as an outer insert portion or outer support member. Dimple portion 74 may be referred to as an inner insert portion or an inner support member. Base portion 72 includes a first end surface 76 (see FIG. 7), a second end surface 78 (see FIG. 8), first, second and third perimeter portions 82, 84, 86 (see FIGS. 7-9) and a hollow interior 80 (see FIG. 8). Base portion 72 has a thickness $T_1$ (see FIG. 8). Dimple portion 74 may include a hollow interior 90 and a thickness $T_2$ (see FIG. 4). A trough 92 may be defined between dimple portion 74 and base portion 72, as shown in FIG. 7. Trough 92 may provide a cavity or space within which dimple portion 74 expands or otherwise moves when compressed.

The first and second end surfaces 76, 78 of base portion 72 may be generally flat or planer. First end surface 76 is configured to contact a support surface 16 after dimple portion 74 is compressed against the support surface 16 (e.g., see FIGS. 5-6). Second end surface 78 is arranged and configured to contact bottom surface 46 of top surface layer 20 of modular floor tile 12 (see FIGS. 4-6). Base portion 72 has a generally cylindrical shape with a constant diameter $D_1$ along the first and second perimeter portions 82, 84. Second perimeter portion 84 may have a reduced diameter $D_2$. Second perimeter portion 84 may define a recess along an outer circumferential surface of base portion 72. The recess defined by second perimeter portion 84 (e.g., the difference between the diameter $D_2$ of second perimeter portion 84 and the diameters $D_1$, $D_3$ of first and third perimeter portions 82, 86) may be referred to as an annular groove, annular recess, or circumferential recess. The recess or groove defined by second perimeter portion 84 may provide increased compressibility for base portion 72. Other constructions for base portion 72 may include a constant diameter along an entire length of base portion 72 between first and second end surfaces 76, 78, or a tapered construction along at least portions of the length of base portion 72. Other arrangements may include a plurality of annular recesses or grooves, wherein the addition of a second or additional annual groove may increase compressibility of the base portion.

Base portion 72 may have other cross-sectional shapes besides the circular cross-sectional shape shown in FIGS. 7-11. For example, base portion 72 may have an oval, hexagonal, square or triangular cross-sectional shape. Base portion 72 may have different cross-sectional shapes along its length between first and second end surfaces 76, 78. Further, base portion 72 may have a thickness $T_1$ that varies along the length between first and second end surfaces 76, 78. For example, thickness $T_1$ may be less along the second perimeter portion 84 than along one or both of the first and third perimeter portions 82, 86. In other arrangements, base portion 72 may have a solid construction without a hollow interior 80. In still other examples, hollow interior 80 may extend along only a portion of the length between first and second end surfaces 76, 78. Hollow interior 80 may be isolated or separated from hollow interior 90 with a wall or partition rather than the continuous hollow construction of base portion 72 shown in at least FIGS. 4-6. Hollow interior 80 may be open and accessible along the second end surface 78.

Dimple portion 74 may have a generally contoured outer surface. Dimple portion 74 may have a hemispherical or dome shaped construction that may be referred to as a convex shape along its exterior surface. Many other shapes are possible for dimple portion 74 including, for example, a cubical or cylindrical shape. Thickness $T_2$ of dimple portion 74 (see FIG. 4) may be constant. In other arrangements, thickness $T_2$ may vary to customize compressibility of dimple portion 74.

Figure 5:
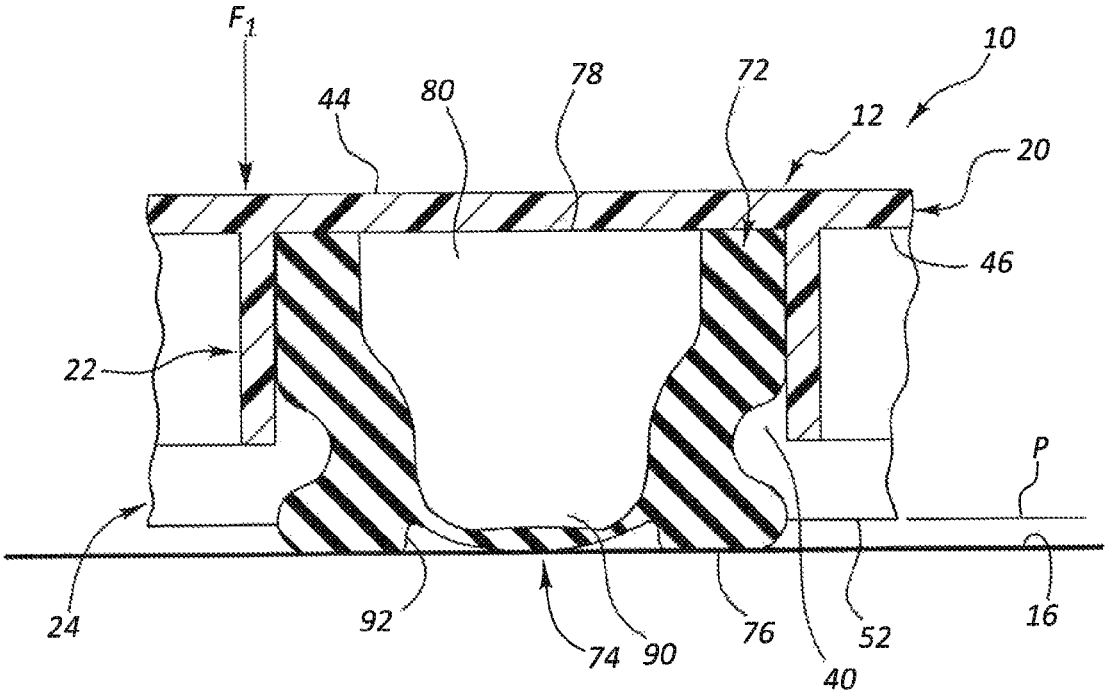
FIG. 5 shows the cross-sectional view of FIG. 4 with a first portion of a resilient insert compressed.

Trough 92 may provide a space into which dimple portion 74 compresses or deforms upon application of a force to modular floor tile 12, as shown in FIGS. 4 and 5. Trough 92 may be referred to as a transition area between base portion 72 and dimple portion 74. Trough 92 may provide a connecting function between base portion 72 and dimple portion 74 and may be referred to as a connector or alignment features.

Figure 6:
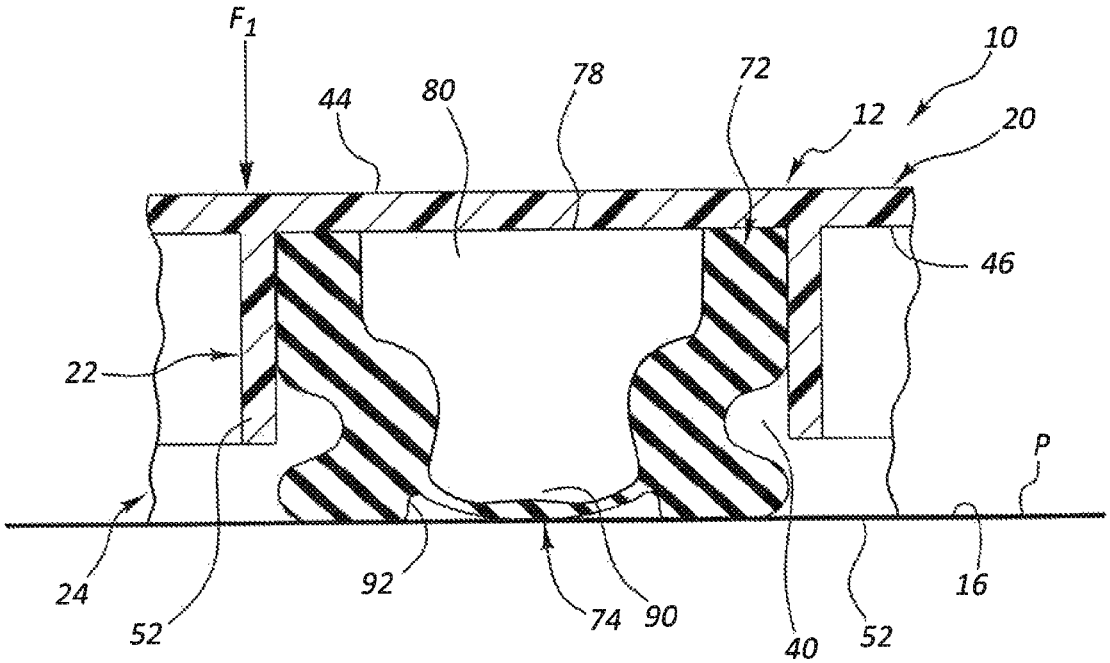
FIG. 6 shows the cross-sectional view of FIG. 4 with first and second portions of the resilient insert compressed.

As a force $F_1$ is applied to top surface 44 of modular floor tile 12, as shown in FIG. 4, dimple portion 74 contacts support surface 68 and begins to compress or deform in a direction toward bottom surface 46 of top surface layer 20. Dimple portion 74 continues to deform until first end surface 76 of base portion 72 contacts support surface 16, as shown in FIG. 5. Further application of force $F_1$ begins to compress or deform base portion 72, as shown in FIG. 6. Base portion 72 compresses until second end 52 of first rigid support members 22 contacts support surface 16. Compressing dimple portion 74 alone may be referred to as a first stage or phase of shock absorption. Compressing both dimple portion 74 and base portion 72 may be referred to as a second stage or phase of shock absorption. Other stages of shock absorption may be possible for resilient insert member 14 by compressing various features such as, for example, first, second and third perimeter portions 82, 84, 86 in separate stages.

Hollow interior 80 may be sized and configured to permit deformation of base portion 72 radially inward as base portion 72 is compressed axially towards top surface layer 20. Second perimeter portion 84 may be forced further radially inward as base portion 72 compresses axially towards top surface layer 20. Base portion 72 may compress at a different rate towards top surface layer 20 as compared to the rate of compression of dimple portion 74 towards top surface layer 20. For example, dimple portion 74 may compress relatively quickly upon application of a relatively small amount of force $F_1$. Compression of dimple portion 74 may be referred to as a first stage of compression or shock absorption in floor tile system 10. Once dimple portion 74 is compressed, which may require up to a threshold force $F_1$, base portion 72 may contact the support surface 16 and begin to compress as part of a second stage of compression or shock absorption. The force required to compress base portion 72 may be above a threshold force required to compress dimple portion 74 and may be referred to as a second force or a second stage force. Base portion 72 and dimple portion 74 are compressed up to a maximum compressed state in which the first and/or second rigid support members 22, 24 contact the support surface 16.

Base portion 72 and dimple portion 74 may be designed to customize the amount of time to compress, the amount of force to compress, and the distance of travel of the modular floor tile 12 towards support surface 16 for each stage of the multi-stage compression or shock absorbing function provided by resilient insert members 14. At least the thicknesses $T_1$, $T_2$, diameters $D_1$, $D_2$, material composition, lengths and other structural features of base portion 72 and dimple portion 74 may affect the shock absorption and other functions provided by resilient insert members 14. Other features such as the size and shape of trough 92 and the radius of curvature of dimple portion 74 may affect functionality of resilient insert member 14.

Figure 29:
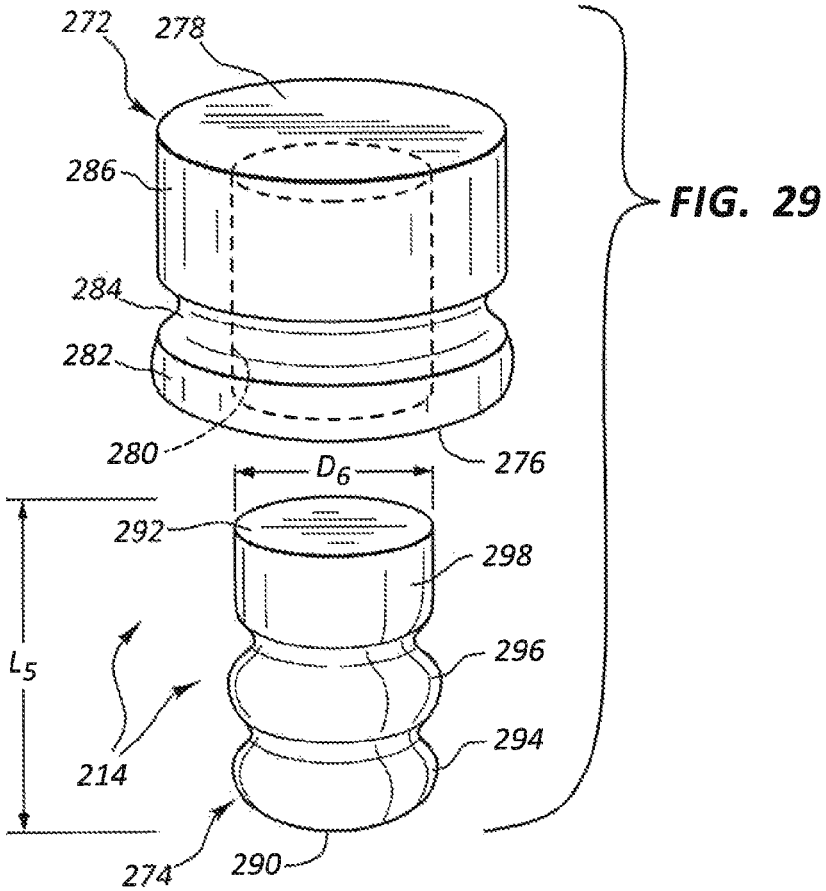
FIG. 29 is an exploded bottom perspective view of another example resilient insert assembly in accordance with the present disclosure.
Figure 30:
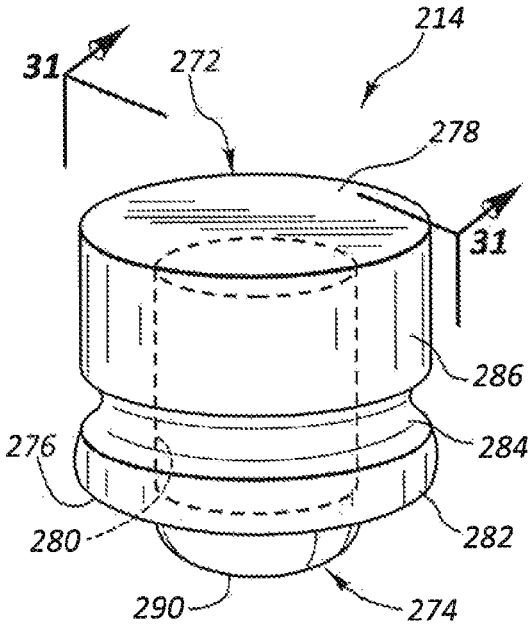
FIG. 30 is a bottom perspective view of the resilient insert assembly of FIG. 29.

In the resilient insert member 14 shown in FIGS. 1-11, dimple portion 74 is integrally formed with base portion 72 to form a single-piece resilient insert member 14. Dimple portion 74 may be described as being carried by or directly connected to base portion 72. In other examples, dimple portion 74 is formed separately from base portion 72. Dimple portion 74 may be a separate piece that is connected to, either permanently or releasably, to base portion 72 or modular floor tile 12. For example, dimple portion 74 may be connected to an insert portion that extends through hollow interior 80 and holds dimple portion 74 at a position adjacent to first end surface 76 of base portion 72. In other examples, dimple portion 74 may be connected to base portion 72 using, for example, adhesives, heat welding, or co-molding. FIGS. 12-28 described below include a multi-stage shock absorbing resilient insert assembly having two separate pieces that are individually and separately mounted to the modular floor tile. FIGS. 29-31 described below show another example multi-stage shock absorbing resilient insert assembly wherein the resilient inserts may be preassembled before being mounted to the modular floor tile.

Figure 33:
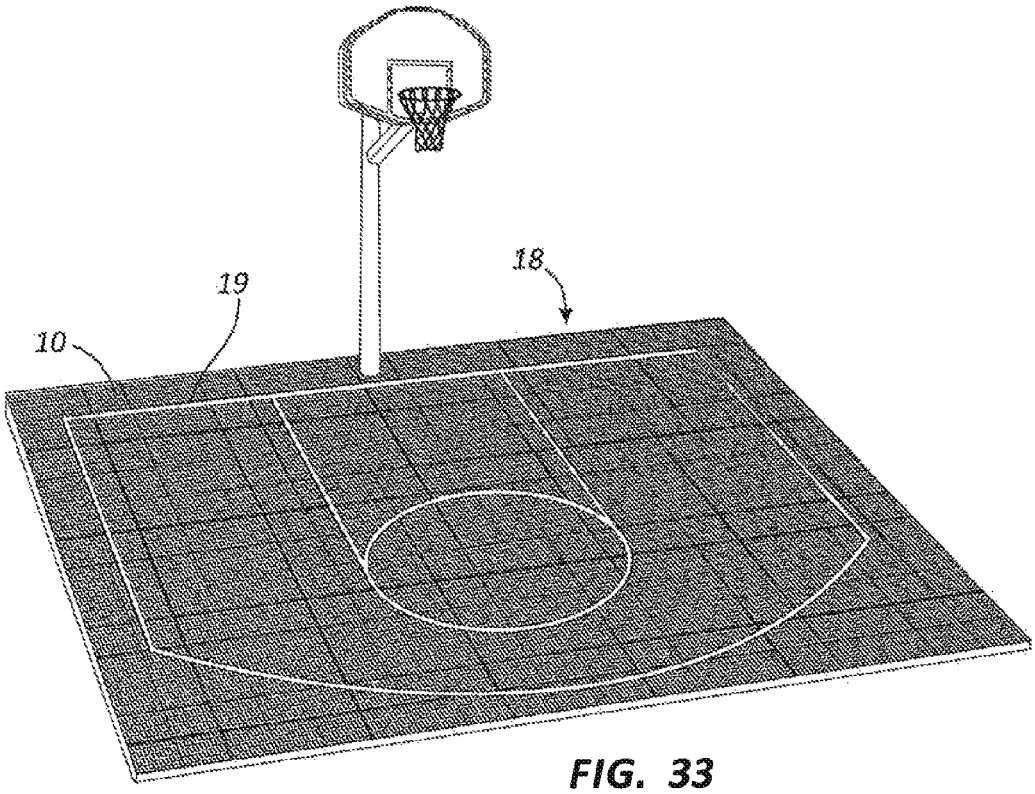
FIG. 33 is a perspective view of a modular floor arranged as a sports court according to the present disclosure.

Referring now to FIGS. 12-16, another example floor tile system 100 is shown including a modular floor tile 112. The modular floor tile 112 may include injection molded plastic. The modular floor tile 112 and other similar or identical tiles may be interlocked according to principles described herein to form a floor, such as a sports court floor shown in FIG. 33. Unlike conventional modular flooring systems, the floor tile system 100 facilitates extra traction and improved cushioning by the addition of at least one multi-stage shock absorbing, resilient insert assembly 114 to the modular floor tile 112 (see FIGS. 13-16).

The modular floor tile 112 of FIGS. 12-16 includes a top surface layer 120, a plurality of first rigid support members 122, a plurality of second rigid support members 124, side edges 126, 128, 130, 132, a plurality of loops 134, a plurality of locking tab assemblies 136, and a plurality of spring fingers 138. The top surface layer 120 has top and bottom surfaces 144, 146. The top surface 144 may be referred to as an open surface. The term "open" indicates that the top surface 144 includes open holes, gaps, or spaces (referred to as surface holes 148) through which fluid may drain. For example, the modular floor tile 112 of FIGS. 12-16 may include a plurality of diamond shaped surface holes 148 patterned relative to the rectangular or square shape of the modular floor tile 112 as shown. However, any other shape for the surface holes 148 and the modular floor tile 112 may also be used.

Figure 15:
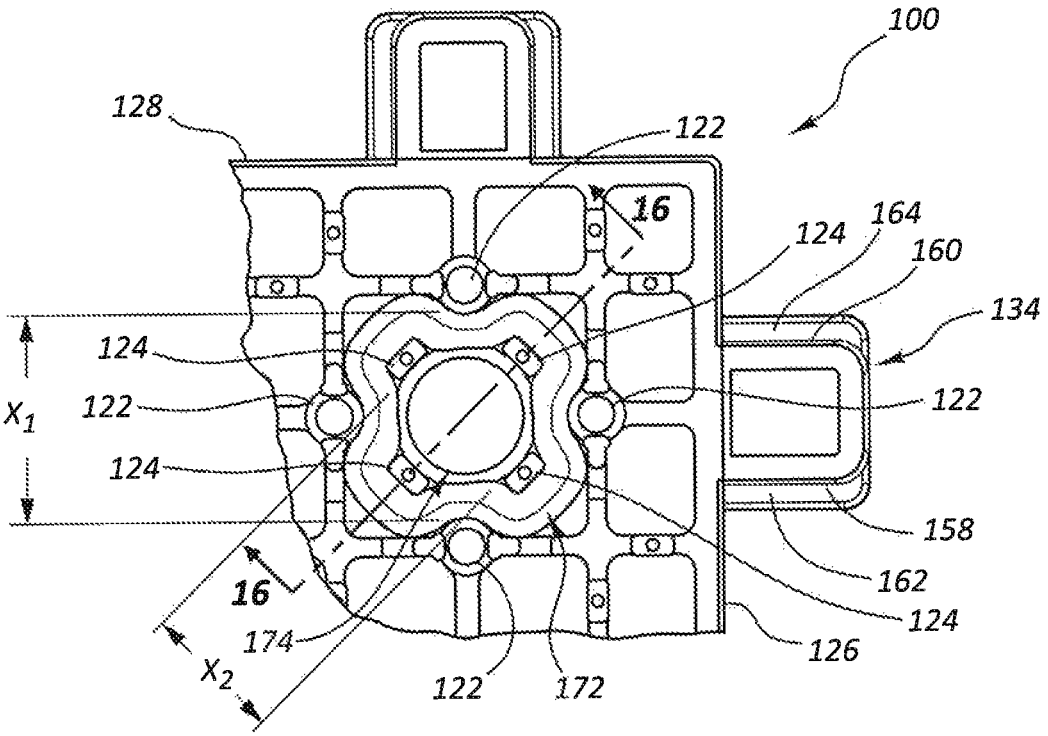
FIG. 15 is a bottom view of a portion of the floor tile system of FIG. 12.
Figure 16:
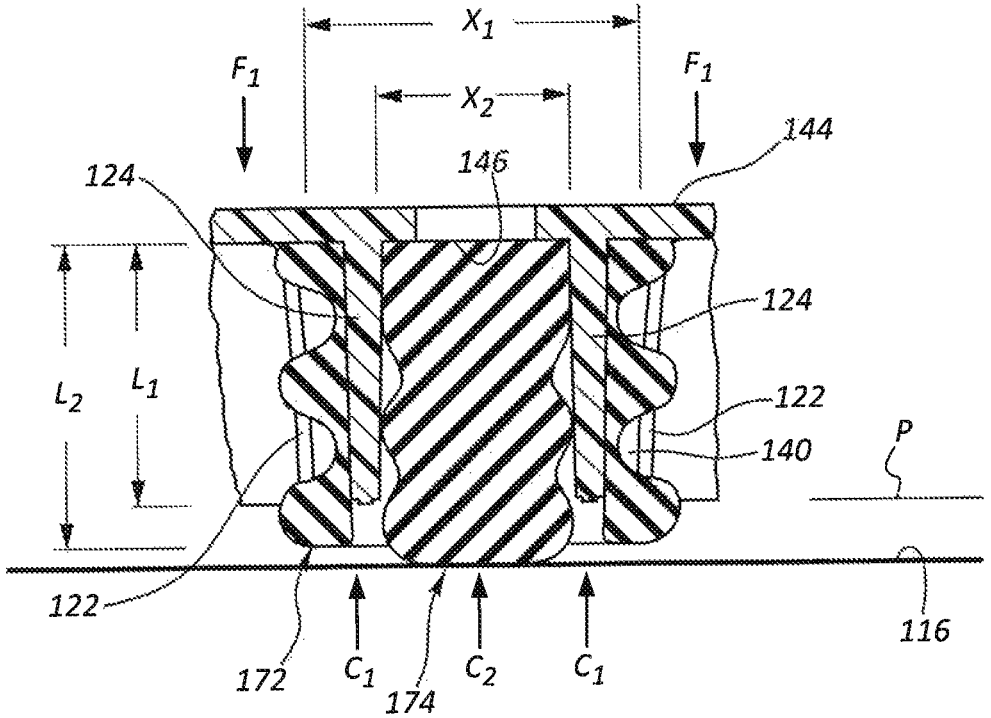
FIG. 16 is a cross-sectional view of the portion of the floor tile system of FIG. 15 taken along cross-section indicators 16-16.

The first rigid support members 122 may include first and second ends 150, 152 and have a length $L_1$ (see FIG. 16). A group of first rigid support members 122 may have a spacing $X_1$ between opposing first rigid support members 122, as shown in FIGS. 15 and 16. The second rigid support members 124 may include first and second ends 154, 156 and have a length $L_2$ (see FIG. 16). A group of second rigid support members 124 may have a spacing $X_2$ between opposing second rigid support members 124, as shown in FIGS. 15 and 16.

Figure 12:
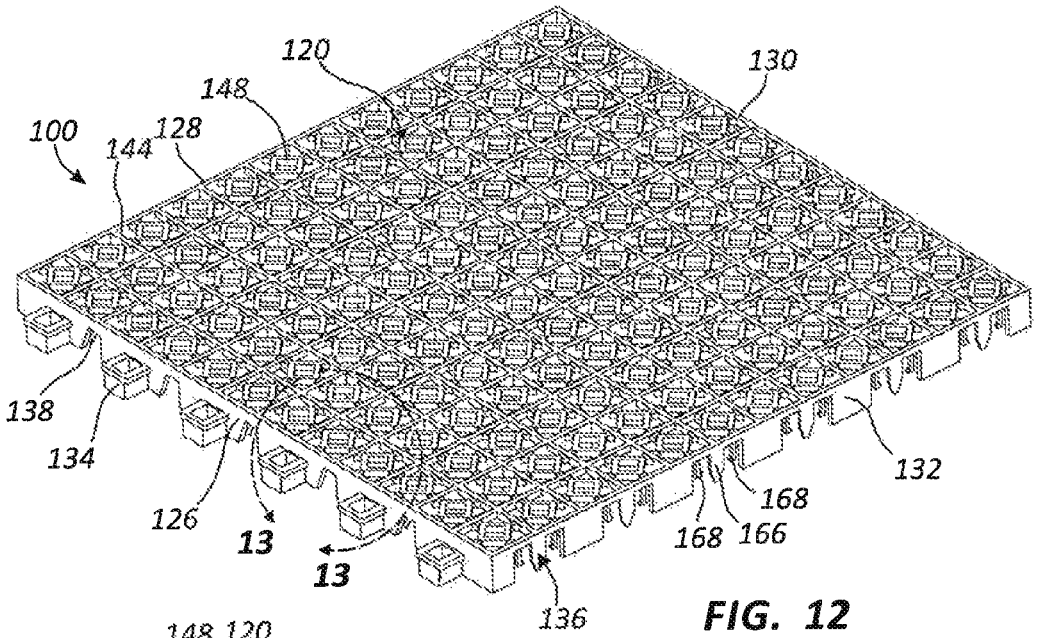
FIG. 12 is a perspective view of another example floor tile system in accordance with the present disclosure.
Figure 13:
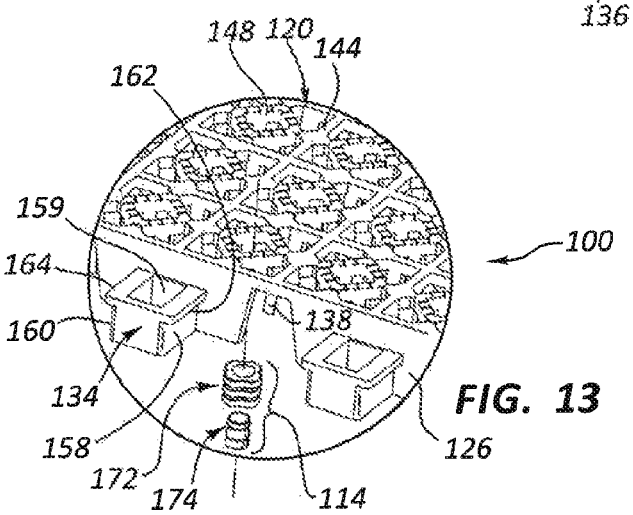
FIG. 13 is a close-up view of a portion of the floor tile system of FIG. 12.
Figure 14:
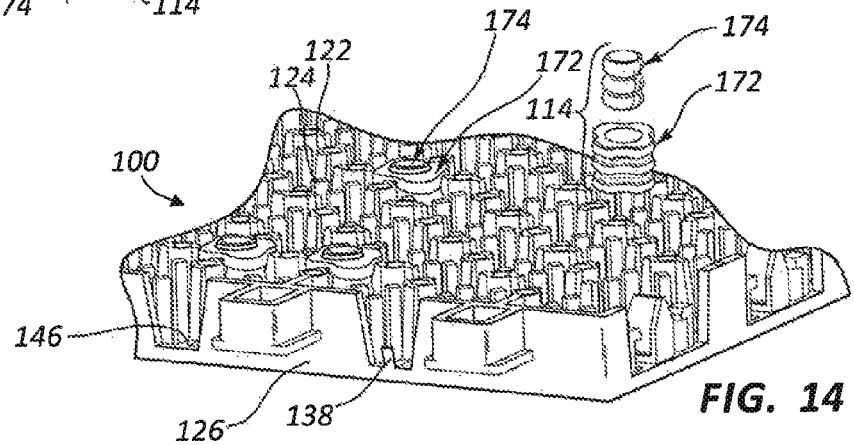
FIG. 14 is a bottom perspective view of a portion of the floor tile system of FIG. 12.

The loops 134 may be positioned along at least one of the side edges 126, 128, 130, 132, such as the side edges 126, 128 shown in FIG. 12. Loops 134 may be spaced along the side edges 126, 128 at substantially equal intervals. In at least one example, loops 134 may be disposed along the side edges 126, 128 at varying intervals. Each of the loops 134 may include first and second sides 158, 160, an aperture 159, and first and second lips 162, 164, as shown in FIG. 13. The first and second lips 162, 164 may protrude from opposing sides of the loops 134.

Each of the plurality of loops 134 may be receptive of a mating locking tab assembly 136 from an adjacent modular floor tile 112. The locking tab assemblies 136 may be positioned along any one of the side edges 126, 128, 130, 132 and particularly the side edges 130, 132 shown in FIG. 12. The modular floor tile 112 may include an equal number of locking tab assemblies 136 and loops 134. The locking tab assemblies 136 may be spaced at the same intervals as the spacing of loops 134. Each of the locking tab assemblies 136 may include a center post 166 and a pair of flanking hooks 168 each having a prong 170. As adjacent modular floor tiles 112 are locked together (e.g., see assemblies of FIGS. 32 and 33), a center post 166 may be inserted into an associated loop 134, and flanking hooks 168 may flex around and snap over associated first and second lips 162, 164 of that loop 134. Once snapped over first and second lips 162, 164, the flanking hooks 168 may resist disconnection of adjacent modular floor tiles 112, while permitting a certain amount of sliding lateral displacement between adjacent modular floor tiles 112.

Adjacent modular floor tiles 112 may be biased or spring loaded to a specific, generally equal spacing. One or more of the side edges 126, 128, 130, 132 may include one or more biasing members such as spring fingers 138 disposed therein. Spring fingers 138 may tend to bear against adjacent side walls of adjacent modular floor tiles 112, thereby aligning the modular floor tiles 112 of a modular floor tile system to a substantially equal spacing while also permitting lateral displacement upon the application of a sufficient lateral force.

Each of the modular floor tiles 112 may include a support system under the top surface layer 120. The support system may include a multi-component, multi-tier suspension system. Some of the components of the support system may be integrally formed with the modular floor tile 112 (e.g., injection molded as a single piece with the top surface layer 120). Other portions of the support system may be releasably attached to the modular floor tile 112. For example, the support system may include a plurality of resilient insert assemblies 114, which are releasably mounted to other portions of the support system such as at least one of the first or second rigid support members 122, 124. The resilient insert of assemblies may form at least one resilient level.

The support system may also include the first rigid support members 122 and second rigid support members 124, which form at least one rigid level. The resilient insert assemblies 114 may comprise resilient materials such as, for example, an elastomer such as rubber, silicone, or polymer. Many other suitable resilient materials are possible. Furthermore, the resilient insert assemblies 114 may have components with various shapes, sizes, and resilient and/or elastomeric properties. Components of the resilient insert assemblies 114 may be compressible under various forces, including forces applied to the top surface layer 120. The resilient insert assemblies 114 may comprise multiple components and may be referred to as multi-stage shock absorbing members or multi-component shock absorbing assemblies for use with the modular floor tile 112.

The resilient insert assemblies 114 may include a first resilient support member 172 (also referred to as an outer insert or outer support member—see FIGS. 21-24), and a second resilient support member 174 (also referred to as an inner insert or inner support member—see FIGS. 25-28). The first resilient support member 172 may include first and second ends 176, 178, a pass through bore 180, first, second and third perimeter portions 182, 184, 186, and a plurality of nest recesses 188 (see FIGS. 21-24). The pass through bore 180 extends from the first end 176 to the second end 178. The first, second and third perimeter portions 182, 184, 186 are spaced apart along a length $L_3$ between the first and second ends 176, 178 (see FIG. 23). The first, second and third perimeter portions 182, 184, 186 include diameters $D_1$ and be separated by grooves 183, 185 having diameters $D_2$. The diameters $D_1$, $D_2$, $D_3$, may be different from each other. In at least one example, the diameters $D_1$ are the same and the diameters $D_2$ are the same and less than the diameters $D_1$. The first resilient support member 172 may include additional perimeter portions along the length $L_3$. Each of the perimeter portions may have a different diameter and each of the grooves may have a different diameter.

Figure 23:
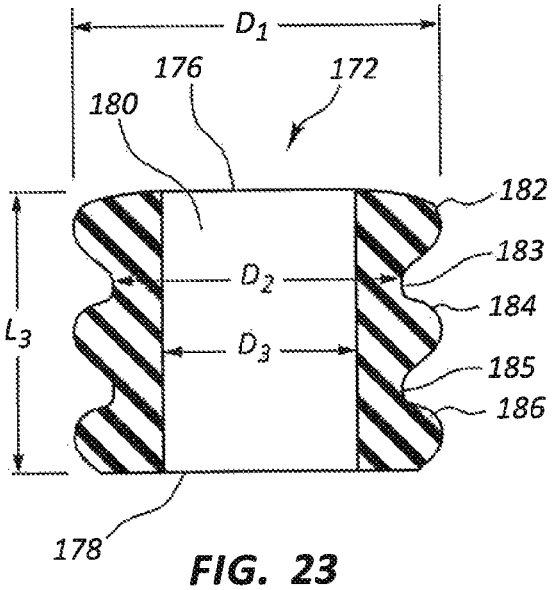
FIG. 23 is a cross-sectional view of the outer insert of FIG. 21 taken along cross-section indicators 23-23.

The pass through bore 180 may include an internal diameter $D_3$ (see FIG. 23). The pass through bore 180 may be sized to receive the second resilient support member 174 and at least some of the second rigid support members 124.

Figure 24:
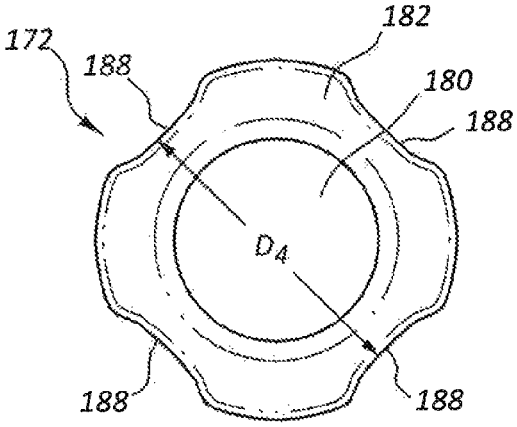
FIG. 24 is a top view of the outer insert shown in FIG. 21.
Figure 25:
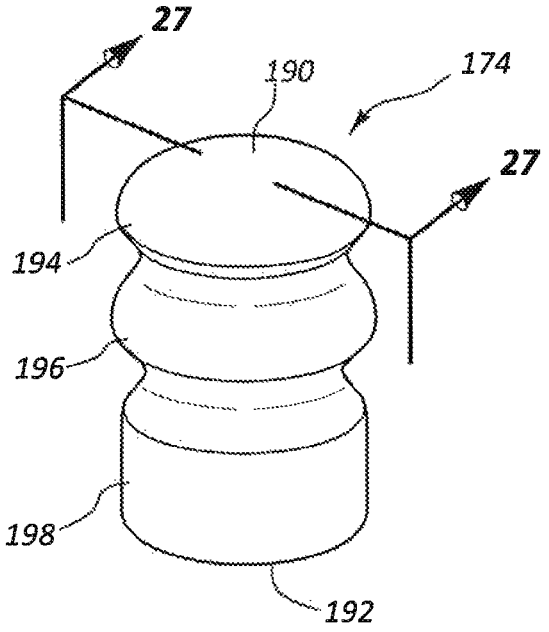
FIG. 25 is a top perspective view of an inner insert of the floor tile system of FIG. 12.
Figure 26:
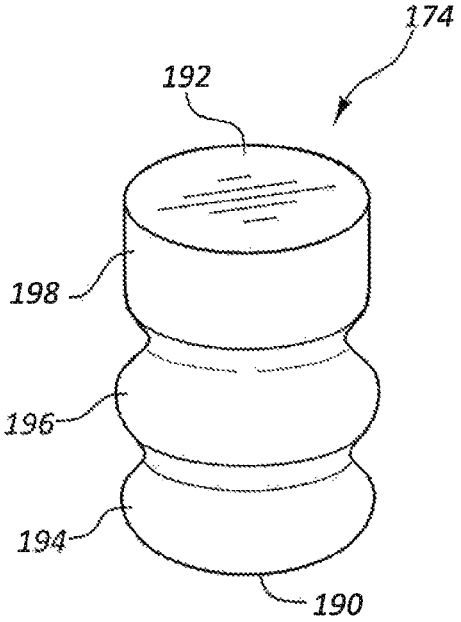
FIG. 26 is a bottom perspective view of the inner insert of FIG. 25.

The nest recesses 188 may be formed along exterior peripheral surfaces of at least some of the first, second, and third perimeter portions 182, 184, 186. The nest recesses 188 may assist in inserting the first resilient support members 172 between a group or cluster of first rigid support members 122. The spacing between the nest recesses 188 may have a diameter $D_4$ as shown in FIG. 24. The diameter $D_4$ may be substantially the same as an internal spacing $X_1$ between opposite oriented first rigid support members 122 in a grouping or cluster of four first rigid support members, as shown in FIGS. 15 and 16. In at least some arrangements, the diameter $D_4$ is greater than the internal spacing $X_1$ such that an interference fit is provided between the first resilient support member 172 and the nest of first rigid support members 122.

Figure 27:
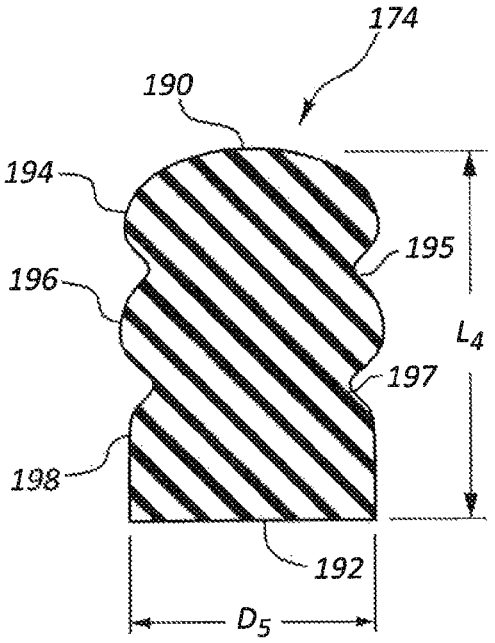
FIG. 27 is a cross-sectional view of the inner insert of FIG. 25 taken along cross-section indicators 27-27.
Figure 28:
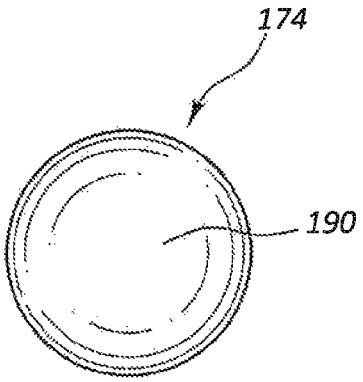
FIG. 28 is a top view of the inner insert of FIG. 25.

The second resilient support members 174 include first and second ends 190, 192, and first, second and third perimeter portions 194, 196, 198 and be separated by grooves 195, 197 (see FIGS. 25-28). The second resilient support member 174 may have a length $L_4$ (see FIG. 27). The second resilient support member 174 may also have a maximum external diameter $D_5$, as shown in FIG. 27. The second resilient support member 174 may include additional perimeter portions along the length $L_4$. Each of the first, second and third perimeter portions 194, 196, 198 may have a different diameter. FIGS. 25-28 show the first, second and third perimeter portions 194, 196, 198 having the same diameter (which is the same as maximum external diameter $D_5$), and the grooves 195, 197 having the same diameter, which is less than the diameter $D_5$. The maximum external diameter $D_5$ may be substantially the same as an internal spacing $X_2$ between a group or cluster of second rigid support members 124, as shown in FIGS. 15 and 16.

The first and second resilient support members 172, 174 may have different sizes, shapes, and material compositions. The physical differences between the first and second resilient support members 172, 174 may provide different resiliency, compressibility, and flexibility properties for the first and second resilient support members 172, 174. Features of the first and second resilient support members 172, 174 may be modified to alter a performance characteristic of the resilient insert assembly 114. For example, compressibility, shock absorption, or cushioning provided by the resilient insert assembly 114 may be altered by changing features such as size, shape and material composition of the first and second resilient support members 172, 174, individually or in combination. In one example, the maximum external diameter $D_5$ of the second resilient support member 174 may be increased to create additional interference with the group of second rigid support members 124 within which the second resilient support member 174 is positioned. This additional interference may result in increased compression of the second resilient support member 174 before the first and second rigid support members 122, 124 contact the ground surface.

FIGS. 21-24 show the first resilient support member 172 having a generally undulating exterior surface. For example, the first resilient support member 172 may be formed to a generally elongate and/or cylindrical shape having an undulating exterior surface. Similarly, the second resilient support member 174 may have an undulating exterior surface and may have a generally elongated and/or cylindrical shape with a diameter varying at different points along the length $L_4$. The undulating shape of the first and second resilient support member 172, 174 may enable more stable compression and/or rebound of the resilient support member in response to various forces acting on the floor tile system 100. The undulating shape of the first and second resilient support members 172, 174 may also facilitate securement of the resilient support members 172, 174 to the first and second rigid support members 122, 124 of the modular floor tile 112. The undulating shape may additionally enable greater compressibility of the resilient support members and/or may enable greater customization of the resilient support members to suit various sport court or other modular floor requirements.

Either of the first and second resilient support members 172, 174 may have a generally hollow construction. The first and second resilient support members 172, 174 may include a recess or cavity having various shapes, depths and diameters. For example, the cavity may have a generally cylindrical shape with a circular cross-section (e.g., the pass through bore 180 of the first resilient support member 172 shown in FIGS. 21-24). The shape of the pass through bore 180 may have a shape that generally matches an exterior shape of the second resilient support member 174. The size and shape of the cavity formed in either one of the first and second resilient support members 172, 174 may vary the compressibility and/or resilience of that resilient support member or the resilient insert assembly 114 generally. For example, the first resilient support member 172 having a cavity formed as a pass through bore may be more compressible in response to a force than a resilient support member having a relatively small or shallower cavity.

The first and second rigid support members 122, 124 define a bottom plane P for the modular floor tile 112, as shown in FIG. 16. The resilient insert assembly 114 may extend further downward beyond the plane P before being compressed upon application of a force $F_1$, as shown in FIG. 16. The first and second resilient support members 172, 174 may have different lengths and extend different distances from the plane P. The lengths $L_3$ and $L_4$ of the first and second resilient support members 172, 174 may be different and yet extend the same distance downward from the plane P as a result of the interface with the first and second rigid support members 122, 124 to which the first and second resilient support members 172, 174 are mounted. In other arrangements, the lengths $L_3$ and $L_4$ of the first and second resilient support members 172, 174 may be the same and yet extend different distances downward from the plane P as a result of the interface with the first and second rigid support members 122, 124 to which the first and second resilient support members 172, 174 are mounted.

Figure 18:
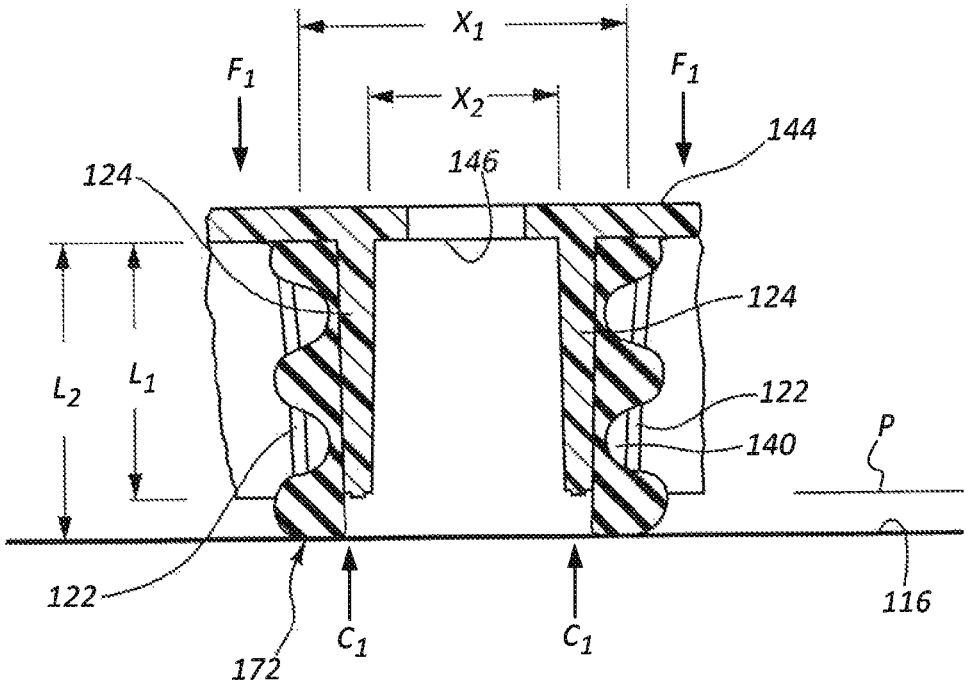
FIG. 18 is a cross-sectional view of the floor tile system shown in FIG. 17 taken along cross-section indicators 18-18.
Figure 20:
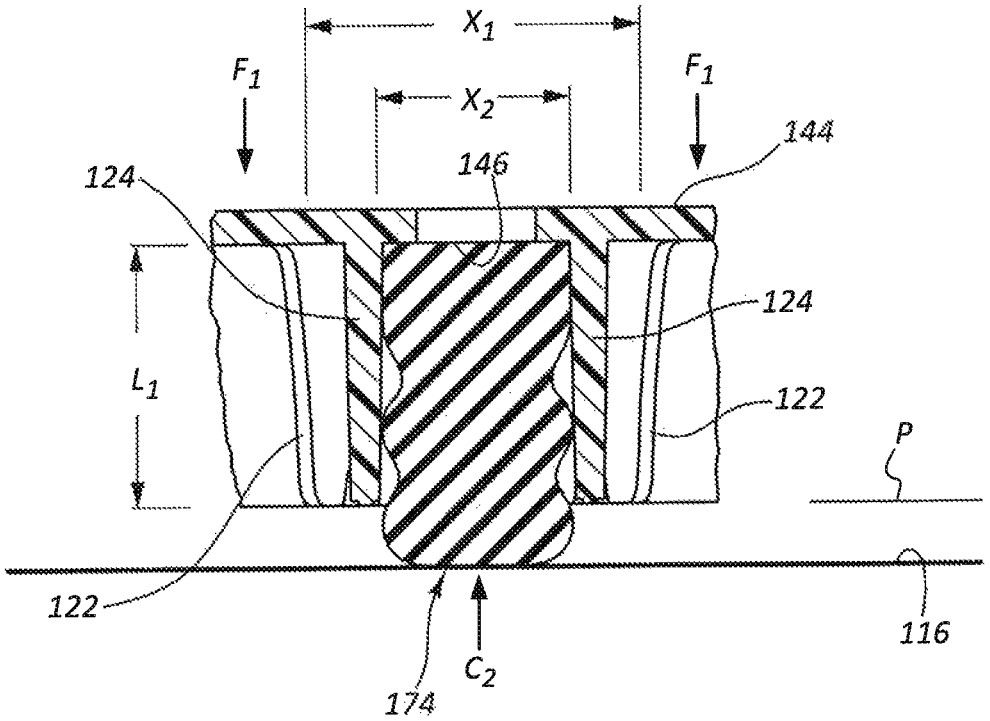
FIG. 20 is a cross-sectional view of the floor tile system of FIG. 19 taken along cross-section indicators 20-20.
Figure 21:
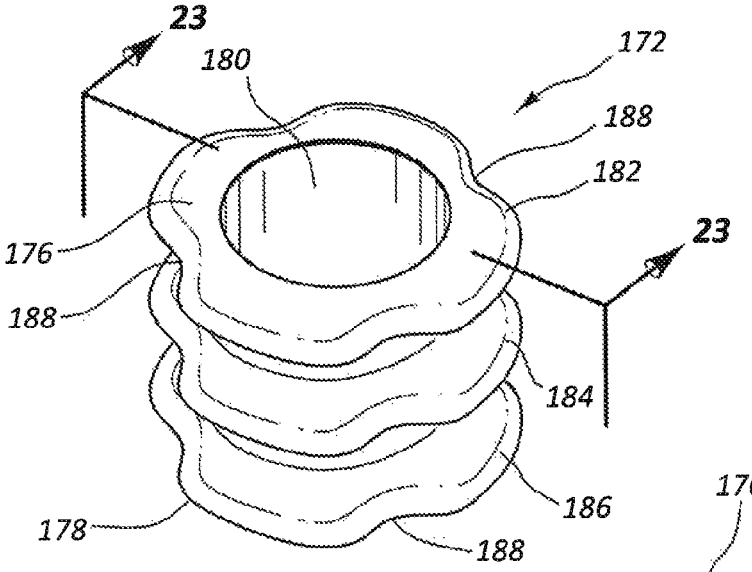
FIG. 21 is a top perspective view of an outer insert of the floor tile system of FIG. 12.
Figure 22:
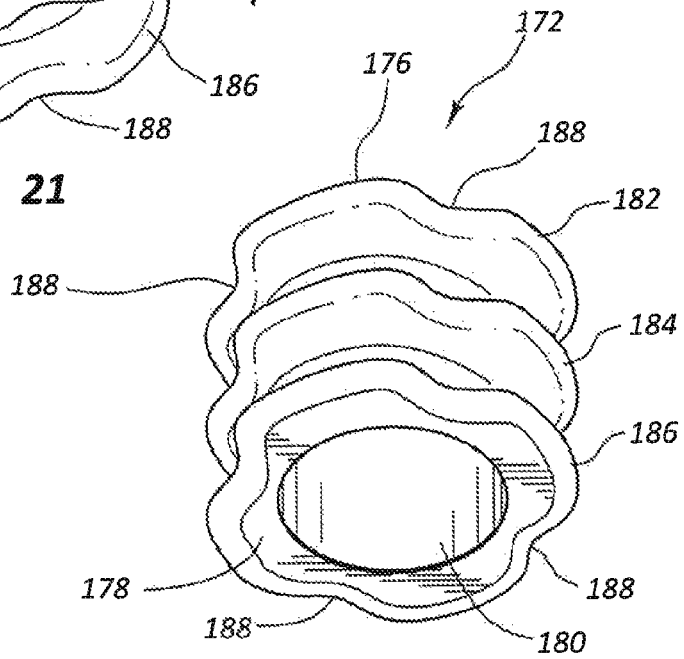
FIG. 22 is a bottom perspective view of the outer insert of FIG. 21.

The resilient insert assemblies 114 may compress under a load against a ground surface 116 (see FIG. 16). FIGS. 16, 18 and 20 show a force $F_1$ applied in a vertically downward direction, which results in compression of the resilient insert members 14 in an opposite compression direction C. For example, when multiple floor tile systems 100 are used to form a sport floor or dance floor, such as the sports floor shown in FIG. 33, each step by a user may apply a localized load on certain of the resilient insert assemblies 114. The resilient insert assemblies 114 may compress under the load, providing a forgiving, cushioning surface for a user. The resilient insert assemblies 114 may rebound to their original length when the load is removed. Accordingly, the floor tile system 100, which includes the resilient insert assemblies 114, may form a more user-friendly playing surface which provides added comfort and protection to a user. The use of resilient insert assemblies 114 may provide cushioning and comfort that reduce the risk of injury to the user.

Additionally, the resilient insert assemblies 114 may frictionally engage a ground surface or other suitable surface that supports the floor tile system 100. The frictional interface between the resilient insert assemblies 114 and the ground surface may reduce movement of the modular floor system 100 in a lateral direction. The resilient insert assemblies 114 may be formed from various materials suitable for increasing traction of the floor tile system 100 relative to various ground surfaces. Additionally, the resilient insert assemblies 114 may be designed to provide additional traction in wet and/or dry conditions on the ground surface.

The resilient insert assemblies 114 may be removably mounted to the modular floor tiles 112. The resilient insert assemblies 114 may enable relatively easy, cost efficient repair of the floor tile systems 100. Further, the multi-component nature of the resilient insert assemblies 114 may provide for customization of the cushioning and/or frictional properties of the floor tile system 100 by using only one or the other of the first and second resilient support members 172, 174 at various locations on the modular floor tile 112 while using combinations of the first and second resilient support members 172, 174 at other locations on the modular floor tile 112. The resilient insert assemblies 114, or components thereof, may be easily removed or replaced in existing sports courts or other surfaces comprising the floor tile systems 100. Additionally, the removable and/or replaceable resilient insert assemblies 114, or components thereof, may enable relatively easy and cost-effective customization of individual floor tile systems 100, or entire modular floors such as the court floor 118 shown in FIG. 33. For example, various types of floor tile systems 100 having various characteristics, such as varying traction and resiliency, and may be modified by merely altering the number of resilient insert assemblies 114, altering their placement on individual modular floor tiles 112, or using the first and second resilient support members 172, 174 individually or in combination.

Additionally, resilient insert assemblies 114 may provide floor tile systems 100 with noise dampening characteristics. For example, resilient insert assemblies 114 may prevent relatively rigid portions of the modular floor tiles 112 (e.g., the first and second rigid support members 122, 124) from contacting a ground surface or other surface underneath the floor tile system 100. The resilient insert assemblies 114 may reduce excessive noise by slowing the rate at which a portion of the modular floor tile 112 approaches and contacts a ground surface, thereby lessening the impact force with which the modular floor tile 112 contacts the ground surface.

Figure 17:
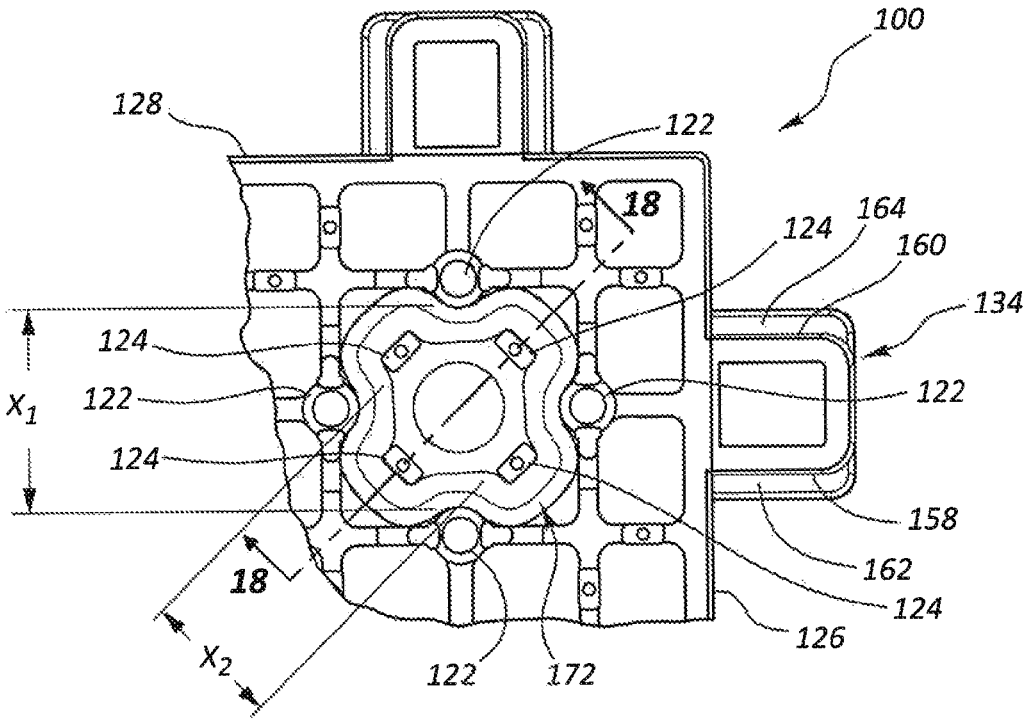
FIG. 17 is a bottom view of a portion of the floor tile system of FIG. 12 with a center insert removed.
Figure 19:
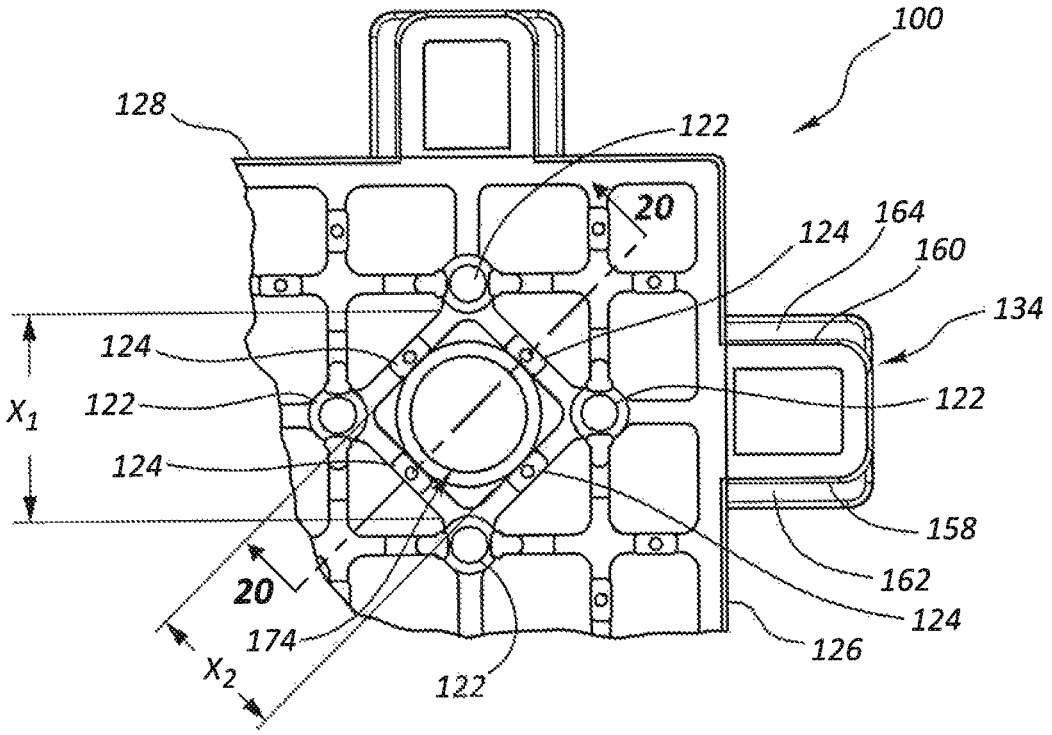
FIG. 19 is a bottom view of a portion of the floor tile system of FIG. 12 with the outer insert removed.

FIGS. 17-20 show alternative arrangements for the resilient insert assembly 114 on a modular floor tile 112. FIGS. 17 and 18 show first resilient support member 172 mounted to the modular floor tile 112 independent of second resilient support member 174. FIGS. 19 and 20 show independent use of the second resilient support member 174 without the first resilient support member 172. A single floor tile system (e.g., such as the one shown in FIG. 1) may include a combination of arrangements for the resilient insert assembly 114. In some locations, both of the first and second resilient support members 172, 174 are mounted together as an assembly at a single location on a floor tile. At other locations, a first resilient support member 172 is used independent of a second resilient support member 174. At other locations, a second resilient support member 174 is used independent of a first resilient support member 172. A user may customize properties of the floor tile system 100 such as, for example, frictional contact with a ground surface and cushioning of forces applied by a user by using different combinations and arrangements for the first and second resilient support members 172, 174.

The resilient insert assemblies 114 may be nested in groups of 3, 4 or more of the first and second rigid support members 122, 124 of the modular floor tile 112. For example, the first resilient support member 172 may be nested between four first rigid support members 122 as shown in FIGS. 15 and 16. The first rigid support members 122 may extend along nest recesses 188 on the exterior surface of the first resilient support member 172. The second ends 178 of the first resilient support member 172 may contact the bottom surface 146 of the top surface layer 120. A group of several second rigid support members 124 may extend into the pass through bore 180. The second rigid support members 124 may contact an inner surface of the pass through bore 180. The first resilient support member 172 may be captured between the first and second rigid support members 122, 124. The first resilient support member 172 may be releasably connected to the modular floor tile 112 via an interference fit with at least the first rigid support members 122, the second rigid support members 124, or a combination thereof.

The second resilient support member 174 may be inserted within the group of second rigid support members 124. For example, a group of four second rigid support members 124 may be spaced apart a distance $X_2$ sufficient to permit insertion of a portion of the second resilient support member 174 therebetween (see FIG. 15). The second resilient support member 174 may be secured or releasably connected to the modular floor tile 112 via an interference fit with the second rigid support members 124. As the second resilient support member 174 is inserted into a nest or space between the second rigid support members 124, the second resilient support member 174 may apply a radially outward directed force to the second rigid support members 124. This radially outward directed force may move the second rigid support members 124 radially outward. Moving the second rigid support member 124 radially outward may apply a radially outward directed force to the first resilient support member 172 along the pass through bore 180. As such, compressing the second resilient support member 174 may result in transfer of forces in a radially outward direction into the first resilient support member 172, which may make it more difficult to compress the first resilient support member 172.

Compressing the first resilient support member 172 may result in a radially inward directed force to the second rigid support members 124, which apply a radially inward directed force to the second resilient support member 174 positioned between the second rigid support members 124. As such, compressing the first resilient support member 172 toward the top surface layer 120 may result in transfer of forces radially inward into the second resilient support member 174, which may make it more difficult to compress the second resilient support member 174.

The second resilient support member 174 may compress towards the top surface layer 120. In at least some examples, the second resilient support member 174 maintains sufficient interference fit with the second rigid support members 124 so that no contact is made with the bottom surface 146 of the top surface layer 120. In other arrangements, the second resilient support member 174 abuts against the bottom surface 146 of the top surface layer 120 prior to, during, or after compression of the second resilient support member 174.

While the first and second resilient support members 172, 174 may be frictionally held within or between the first and second rigid support members 122, 124 of the modular floor tile 112. Other arrangements are possible in which the first and second resilient support members 172, 174, individually or in combination, are permanently connected to the modular floor tile 112. A permanent connection may be provided using, for example, adhesives, co-molding, welding (e.g., laser or other heat welding), or fasteners.

A space provided between the group or cluster of first rigid support members 122 or between the second rigid support members 124 may be referred to as a nest, receiver, seat, or connection point. The modular floor tile 112 may include a single such nest or seat for receiving the resilient insert assembly 114. Alternatively, a plurality of nests or seats may be provided in the modular floor tile 112 for each of the resilient insert assemblies 114 (e.g., a separate seat or nest for each of the first and second resilient support members 172, 174). Alternative examples may provide for removal of the second rigid support members 124 in the space between the group or cluster of first rigid support members 122. The first and second resilient support members 172, 174 may be connected together and inserted as a single unit into the seat or nest between the first rigid support members 122 instead of being individually inserted and releasably mounted to separate seats or nests between groups of first and second rigid support members 122, 124.

Another example resilient insert assembly 214 is shown and described with reference to FIGS. 29-31. Resilient insert assembly 214 has a two-piece construction having a first resilient support member 272 (also referred to as an outer insert or outer support member) and second resilient support member 274 (also referred to as an inner insert or inner support member) similar to resilient insert assembly 114 described with reference to FIGS. 12-28. First resilient support member 272 may have a construction similar to base portion 72 of resilient insert member 14 described with reference to FIGS. 1-11 and sized to fit within one of the seats 40 of modular floor tile 12.

First resilient support member 272 may have a hollow, generally cylindrical shaped construction. First resilient support member 272 may include first and second end surfaces 276, 278, first, second and third perimeter portions 282, 284, 286, and a hollow interior 280. The hollow interior 280 may be accessible along the first end surface 276. The second end surface 278 may be closed. The second perimeter portion 284 may have a diameter that is smaller than the diameter of the first and third perimeter portions.

Second resilient support member 274 may have a construction similar to second resilient support member 174 described with reference to FIGS. 12-28. Second resilient support member 274 may include first and second ends 290, 292 and first, second and third perimeter portions 294, 296, 298. Typically, second resilient support member 274 has a solid construction. However, other embodiments may include a hollow construction for at least portions of second resilient support member 274. Second perimeter portion 296 typically has a smaller diameter than first and third perimeter portions 294, 298.

The maximum outer diameter $D_6$ (e.g., maximum width dimension—see FIG. 29) of second resilient support member 274 may be substantially the same as an internal diameter $D_7$ (e.g., minimum internal width dimension—see FIG. 31) of hollow interior 280. In some arrangements, second resilient support member 274 is maintained in hollow interior 280 with an interference fit. In some arrangements, first and second resilient support members 272, 274 are permanently connected to each other.

A length $L_5$ of second resilient support member 274 (see FIG. 29) is typically at least as great as a length $L_6$ of hollow interior 280 (see FIG. 31). The lengths $L_5$ and $L_6$ may vary relative to each other and to the length of associated rigid support members of a modular floor tile to which the resilient insert assembly 214 is mounted.

The resilient insert assembly 214 may have any of the functionality and benefits of the resilient insert member 14 and resilient insert assembly 114 describe above. Further, any of the features and functionality described with reference to any of the embodiments disclosed herein may be interchangeable with other embodiments.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A method of assembling a modular floor tile, comprising:

providing a modular floor tile having a top surface layer and a plurality of rigid support members extending from the top surface layer;

providing at least one resilient support assembly comprising first and second resilient support portions;

mounting the first and second resilient support portions to the modular floor tile, the second resilient support portion being positioned within a cavity of the first resilient support portion.

2. The method of claim 1, wherein providing the at least one resilient support assembly includes forming the first and second resilient support portions each as a single, unitary piece.

3. The method of claim 1, wherein providing the at least one resilient support assembly includes forming the first and second resilient support portions as separate pieces.

4. The method of claim 1, wherein mounting the first and second resilient support portions includes concurrently mounting the first and second resilient support portions to the modular floor tile.

5. The method of claim 1, wherein mounting the first and second resilient support portions includes creating an interference fit between the plurality of rigid support members and the first resilient support portion.

6. The method of claim 1, wherein mounting the first and second resilient support portions includes positioning at least one of the plurality of rigid support members between the first and second resilient support portions.

* * * * *